US005746341A

United States Patent [19]

Olson

[11] Patent Number: 5,746,341

[45] Date of Patent: May 5, 1998

[54] COLLAPSIBLE, STACKABLE, HARD-SIDED CONTAINER

[76] Inventor: David Alan Olson, 12 Ridge Rd., St. Peter, Minn. 56082

[21] Appl. No.: 714,580

[22] Filed: Sep. 16, 1996

[51] Int. Cl.[6] ..... B65D 21/00

[52] U.S. Cl. ..... 220/6; 220/1.5

[58] Field of Search ..... 220/6, 1.5, 7

[56] References Cited

U.S. PATENT DOCUMENTS

| | | | |
|---|---|---|---|
| 4,186,841 | 2/1980 | Buckley et al. | 220/6 |
| 4,280,640 | 7/1981 | Daloisio | 220/1.5 X |
| 4,662,532 | 5/1987 | Anderson et al. | 220/6 X |
| 4,735,330 | 4/1988 | Hoss | 220/6 |
| 4,785,966 | 11/1988 | Waltke | 220/1.5 X |

OTHER PUBLICATIONS

Advertisement by Buckhorn, Incorporated, Oct. 1996 issue of trade publication, "Transporation & Distribution".

Brochure from Buckhorn describing "Gravity Feed Bulk Box"; For Feed, Seed, and Pelletized Products Applications.

Brochure from Perstorp Xytec, Inc.; "Xytec Collapsible Pallet Containers Cut Shipping, Material Handling Costs".

*Primary Examiner*—Steven M. Pollard

*Attorney, Agent, or Firm*—Oliff & Berridge, PLC

[57] ABSTRACT

A container having a base portion including four vertical square tube members with one tube member at each corner of the base portion, and bottom surfaces of the base portion sloping inwardly to an elongated opening along the bottom of the base portion that is closed off by a trap door. The upper portion of the container is formed with four additional vertical square tube members that provide support for the upper sides of the container, with the upper square tube members and sides of the container being pinned to the lower vertical square tube members such that the four sides of the container can be folded downwardly onto the base portion when the container is emptied. When folded to an upright position the four upper sides interlock and are held in position by pressure from within the container.

4 Claims, 9 Drawing Sheets

COLLAPSIBLE, STACKABLE, HARD-SIDED CONTAINER

BACKGROUND OF THE INVENTION

1. Field of the Invention

This invention pertains to a collapsible, stackable container for holding and distributing bulk quantities of loose materials. More specifically, the invention is directed to a collapsible, stackable container for holding and distributing bulk quantities of seed used in the agricultural industry.

In the agricultural industry, amongst other industries, there is often a need for a stackable container which can carry bulk quantities of loose materials, and which can be emptied rapidly and subsequently collapsed to a compact size for easy storage when not in use. In the seed processing industry an existing method for bulk seed distribution is a large bag with a drawstring closure at the bottom. Such a bag is plagued with several problems. The bag is not stable and cannot be stacked. Furthermore, when a bag is filled with seed the bag slowly sags to one side or the other. In transit, the bags often shift in the truck which makes unloading of the bags difficult and dangerous. When such a bag is filled with seed it can weigh up to 2500 pounds, thus being very difficult to move or handle efficiently. Existing bulk seed bags are equipped with loops at the top of the bag to receive forklift tines. Unfortunately, during shipment the bags full of seed often shift, thus making it very difficult to align the loops with the tines of the forklift. When a bag is lifted by the forklift, it often has to be placed into a steel frame in order to stabilize it so that it may be lifted over the side of a farmer's truck and emptied. The process of emptying the bag of seed involves the dangerous procedure of reaching underneath the bag filled with over a ton of seed to untie the drawstring closure. A further disadvantage of the existing bag containers for bulk seed is the time that it takes to empty the bag. A bag filled with 2500 pounds of seed can take as long as 45 seconds to empty. In addition, the forklift driver or an assistant must pull the empty bag off the forklift tines. Although the existing bags for distributing bulk quantities of seed take up a relatively small amount of space when empty, the material that the bags are made from provides the additional disadvantage of requiring hand washing after use of the bag.

Additional existing containers for transporting bulk quantities of loose materials have also included some hard sided containers. Existing hard sided containers have the disadvantage however of the inability to be stacked when full, or collapsed after emptying in order to take up less space. Furthermore, existing hard sided containers lack any features that allow the containers to be opened for emptying by the forklift driver without having to get down from the driver's seat, and furthermore, cannot be emptied appreciably faster than existing bag containers.

SUMMARY OF THE INVENTION

An object of the present invention is to provide a stable container that can be stacked when filled and that can be collapsed when empty. A further object of the present invention is to provide a container which can be easily lifted by a lift truck and then emptied by the lift truck driver without having to step down from the driver's seat of the lift truck. Another object of the present invention is to provide a container that can hold as much as 2500 pounds of seed for the agricultural industry, and that can be emptied completely of the seed in a period of less than 10 seconds. Yet another object is to provide containers having a width that allows two containers to be fitted side by side in a standard truck trailer, with the containers not exceeding five feet in height when filled, and being collapsible to a lower height when emptied.

According to the present invention, the foregoing and other objects and advantages are obtained by a container having a base portion including four vertical square tube members with one tube member at each corner of the base portion, and bottom surfaces of the base portion sloping inwardly to an elongated opening defined between two lower members. The elongated opening along the bottom of the base portion is closed off by a trap door. The upper portion of the container is formed with four additional vertical square tube members that provide support for the upper sides of the container, with the upper square tube members and sides of the container being pinned to the lower vertical square tube members such that the four sides of the container can be folded downwardly onto the base portion when the container is emptied.

The trap door of the container is pivotally mounted in the center between two flat bar members that are connected to the bottom of the container. The two lower members extending along the bottom of the container on both sides of the trap door provide openings spaced at the proper distance to accept the times of a standard forklift or pallet jack.

A separate trip hammer assembly can be provided that fits over the forklift tines before the tines are inserted into the spaced openings along the base of the container. The trip hammer assembly is thereby positioned adjacent the pivotally mounted end of the trap door at the base of the container. A lever extending from the trip hammer assembly is connected by a flexible line to a point within reach of the driver of the lift truck when the driver is operating the lift truck. Force exerted on the flexible line by the lift truck driver results in the trip hammer pivoting and pulling on a rod or cable that is connected to a latch mechanism mounted at the distal end of the trap door.

When the four collapsible sides of the container are positioned in the upright position for receipt of the material to be carried by the container, the sides are retained in position by four vertical angle keepers that are each welded to one of the four upper square tube members. The four upper side members are collapsed from a vertical position to a horizontal position on top of the base portion by first lifting each of the sides a small distance vertically and then rotating the side from its vertical position to a horizontal position on top of the base portion.

Each of the sides is welded to a flat bar member that extends along the entire length of each of the vertical edges of the sides. The flat bar members along the edges of the sides are each provided with an elongated hole at the lower end of each of the sides. Each of the elongated holes at the lower ends of the sides accepts a horizontal pin extending from each of the lower square tube members at the four corners of the base portion of the container.

The open tops of each of the square tube members at the four corners of the base portion accept a flat bar alignment tab extending downwardly a short distance from the bottom of each of the upper square tube members. The alignment tabs provide alignment between the square tube members on the base portion of the container and the square tube members along the edges of the upper sides of the container.

The elongated slots through the bottoms of the flat bars welded to the side edges allow the sides to be lifted vertically relative to the horizontal pins extending from the lower square tube members. This vertical movement of the sides disengages the flat bar alignment tabs extending from the upper square tube members into the lower square tube members such that the sides can be pivoted about the horizontal pins to a horizontal position and back to a vertical position. Vertical angle members welded along the sides of the upper square tube members serve as keepers that prevent the upper sides from pivoting past a vertical position when the container is being filled.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DESCRIPTION OF THE PREFERRED EMBODIMENTS

Figure 1:
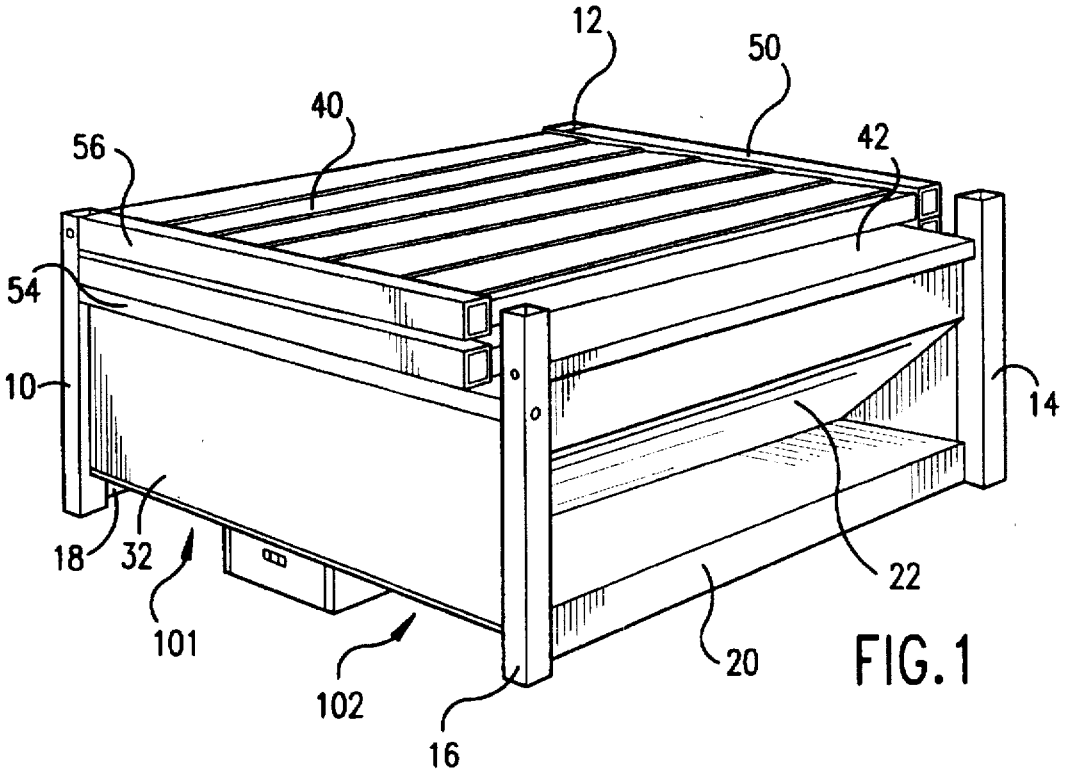
FIG. 1 illustrates a perspective view of the container of the present invention with the side walls collapsed to a horizontal position over the base portion of the container.
Figure 2:
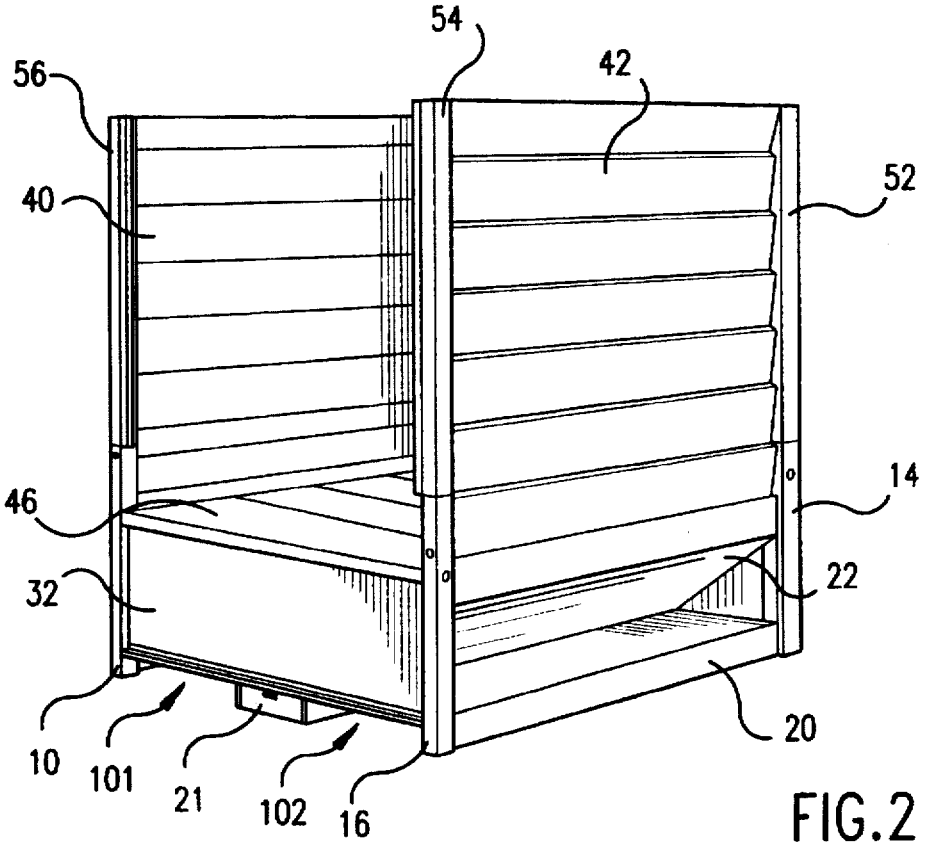
FIG. 2 illustrates a perspective view of the container of the present invention with the three of the side walls in the open position.
Figure 4:
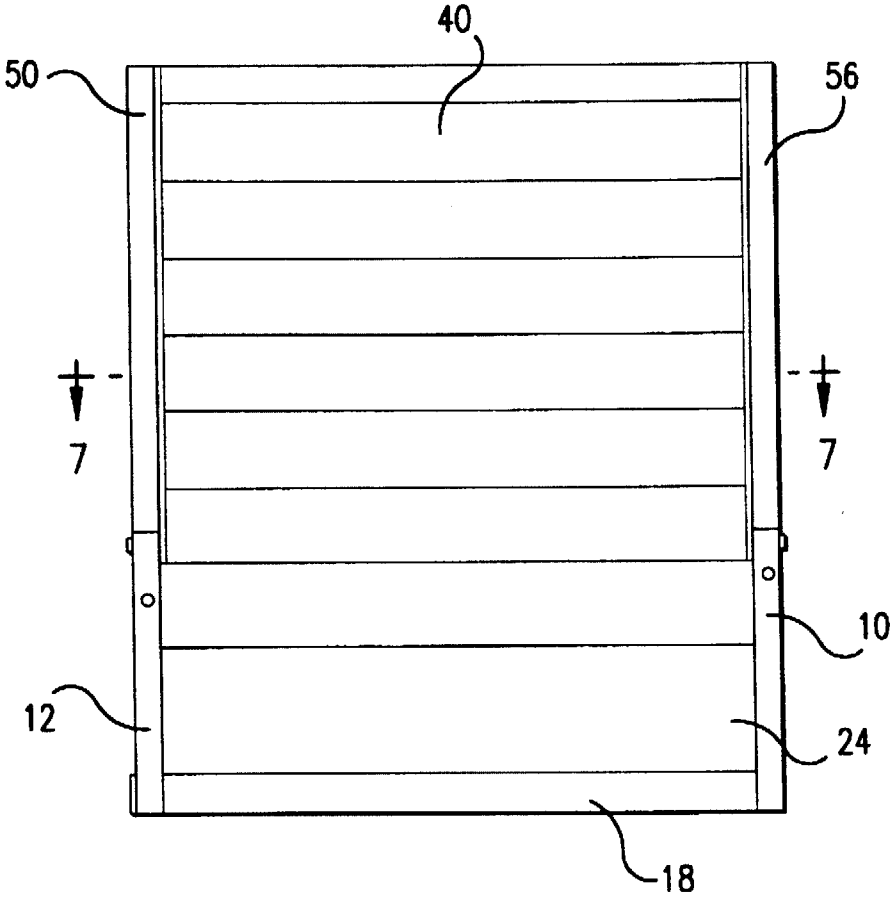
FIG. 4 illustrates a right side elevation view of the container of the present invention.
Figure 3:
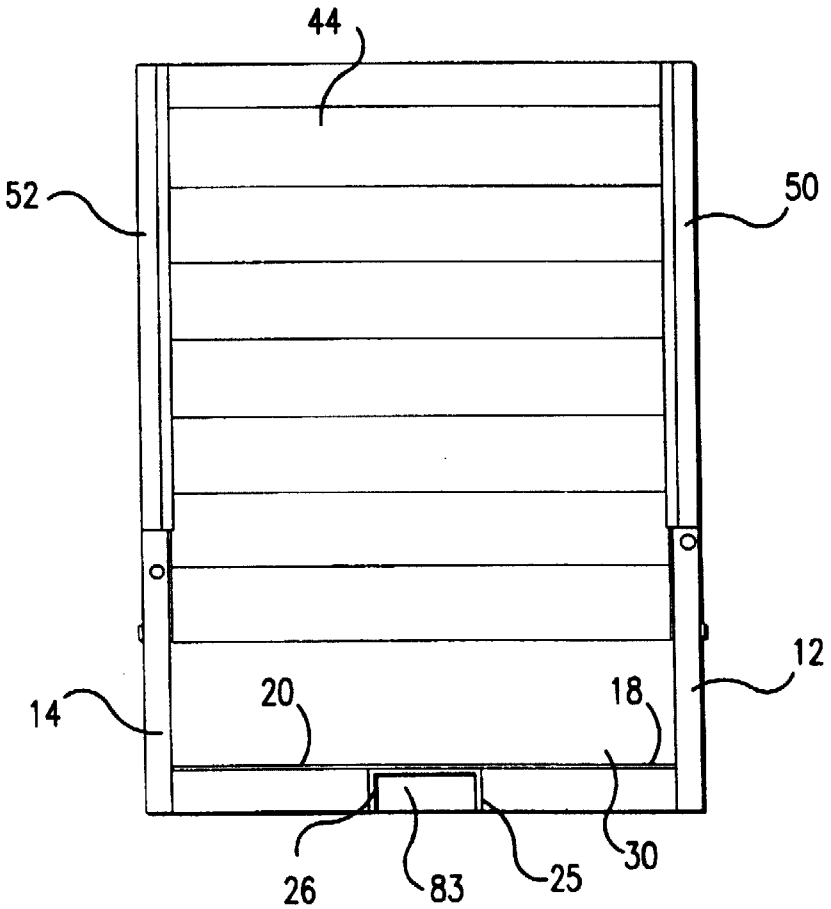
FIG. 3 illustrates a front end view of the container of the present invention.
Figure 6:
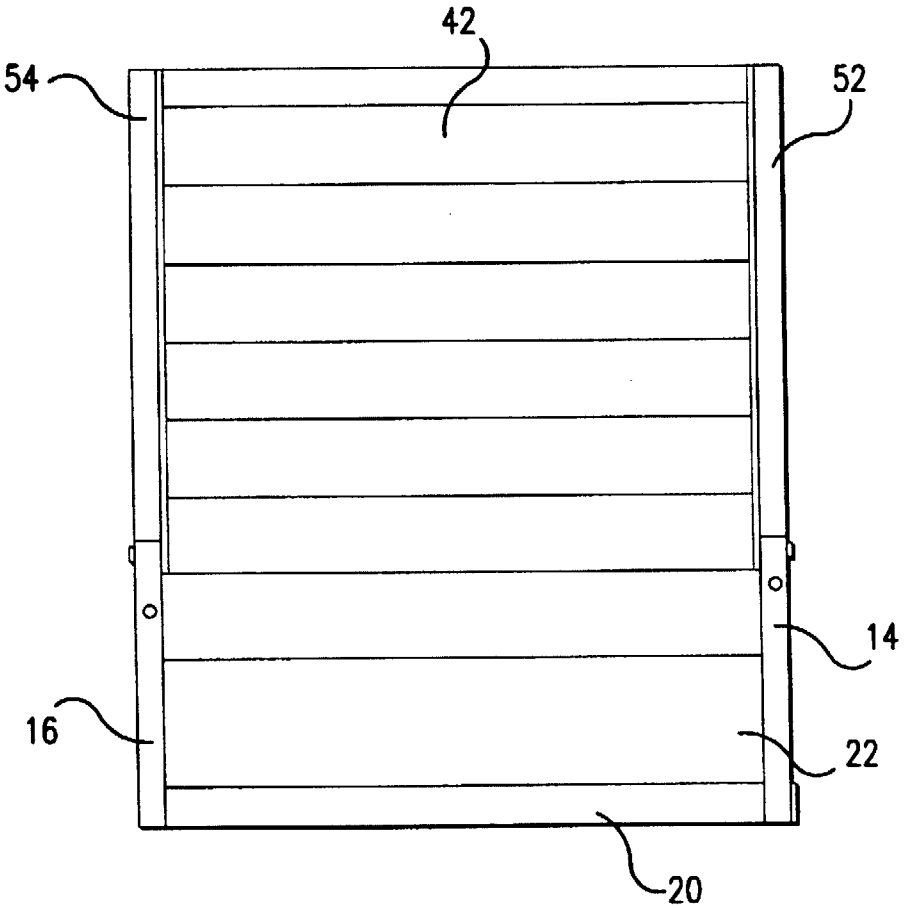
FIG. 6 illustrates a left side elevation view of the container of the present invention.
Figure 5:
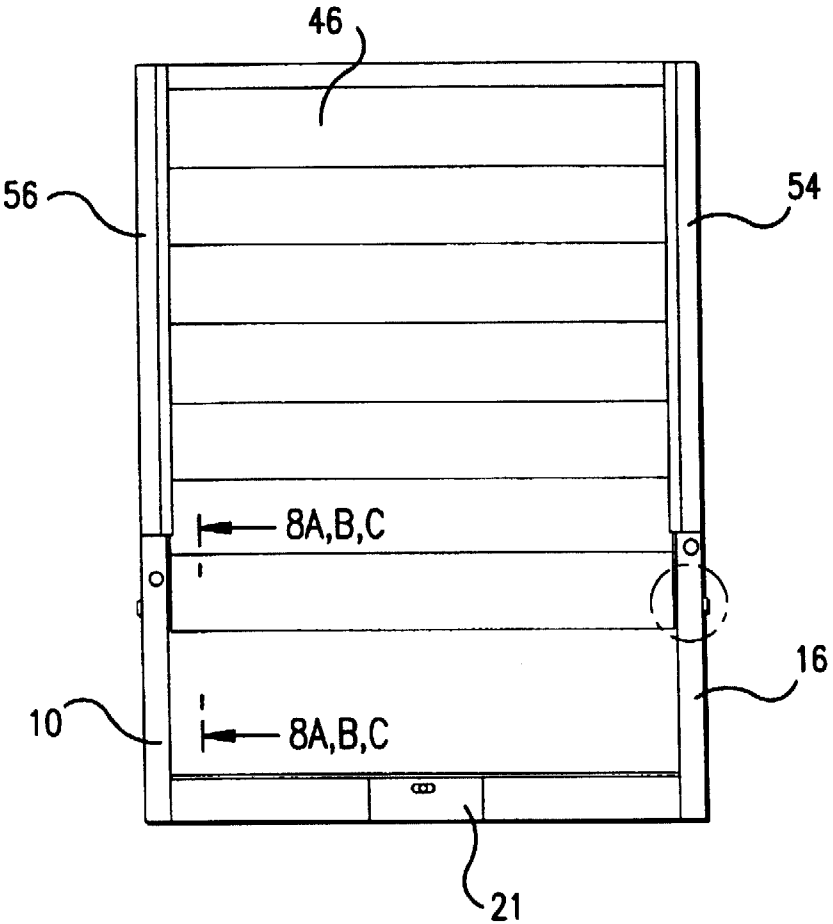
FIG. 5 illustrates a rear end view of the container of the present invention.
Figure 7:
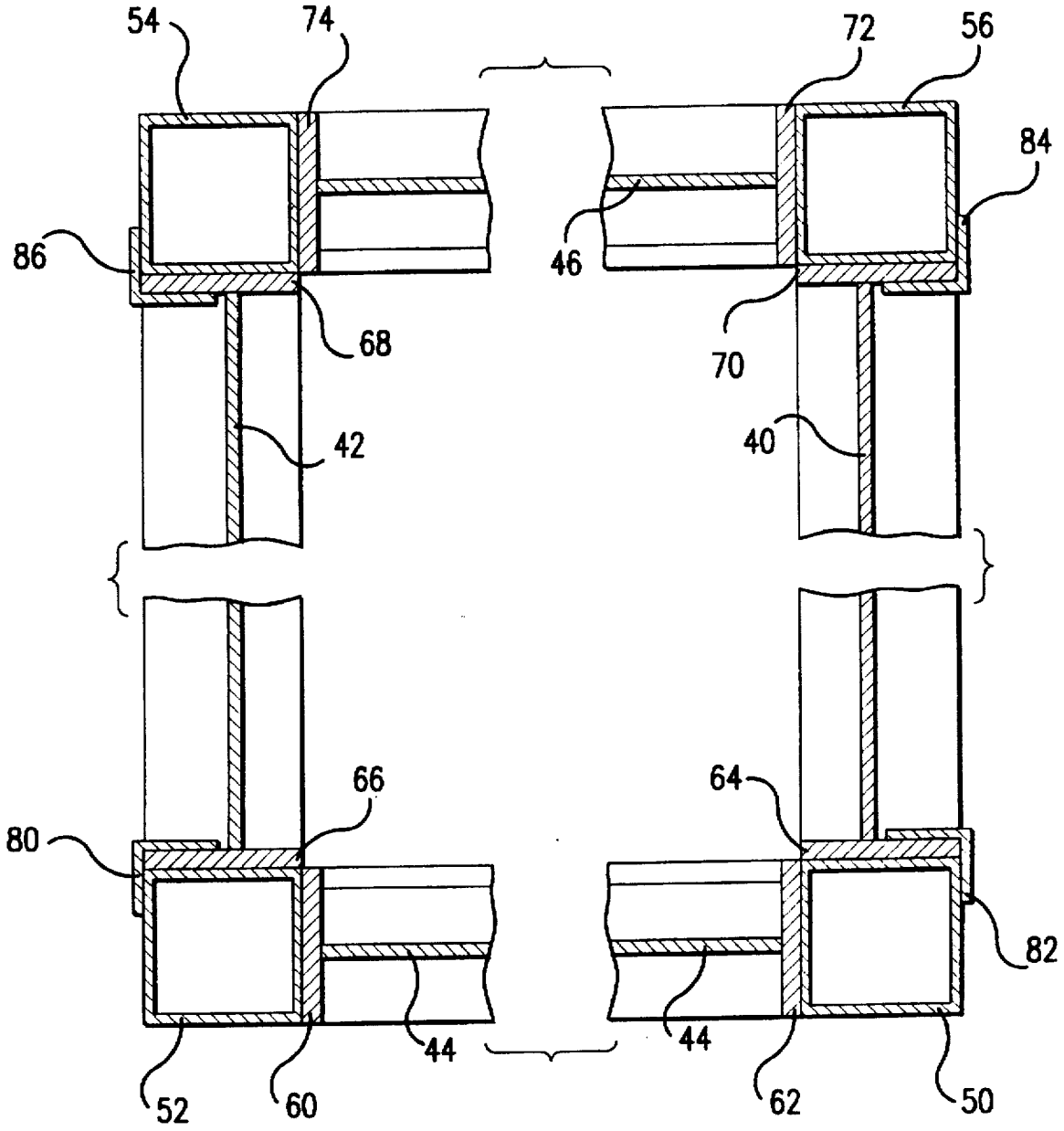
FIG. 7 illustrates an enlarged partial sectional view taken along line 7—7 of FIG. 4.
Figure 8C:
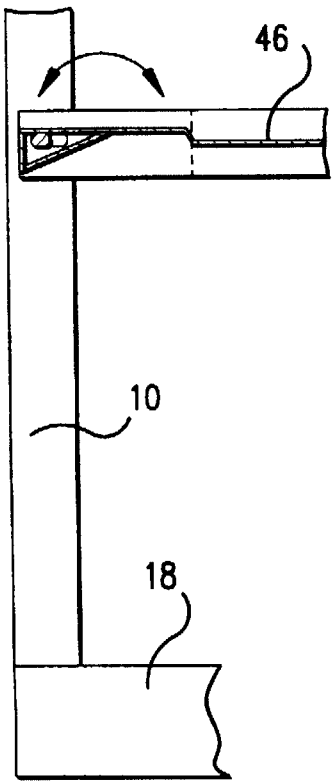
FIG. 8C illustrates a partial cross sectional view of the container of the present invention showing an upper square tube member and side wall pivoted to a horizontal collapsed position.
Figure 8B:
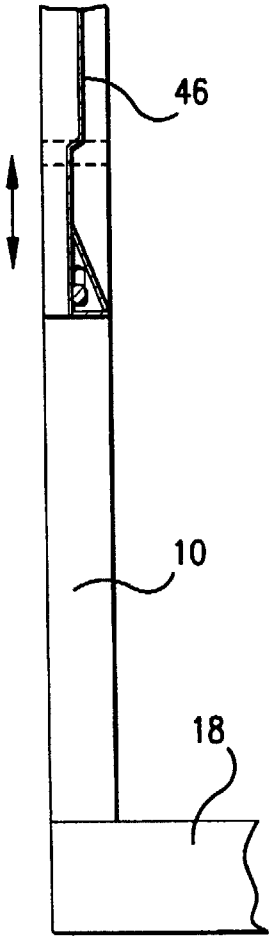
FIG. 8B illustrates a partial cross sectional view of the container of the present invention showing the position of an upper square tube member attached to a side wall of the container with the upper square tube member being disengaged from a lower square tube member prior to or immediately after pivotal motion of the side wall.
Figure 8A:
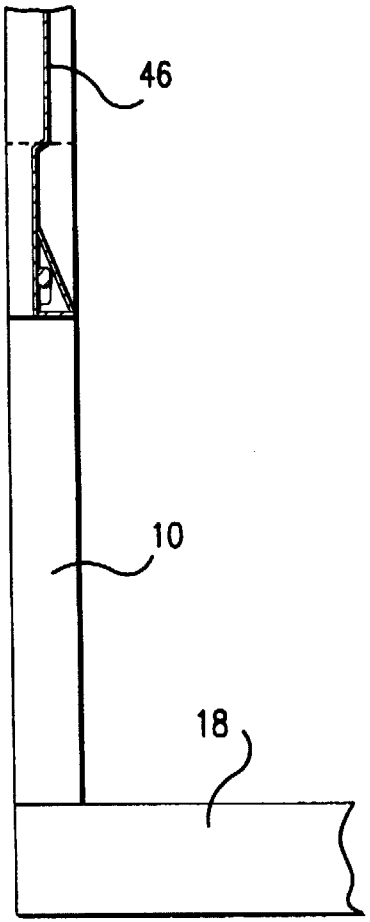
FIG. 8A illustrates a partial cross sectional view of the container of the present invention showing the position of the upper square tube member attached to a side wall of the container with the side wall of the container in its locked vertical position.
Figure 9:
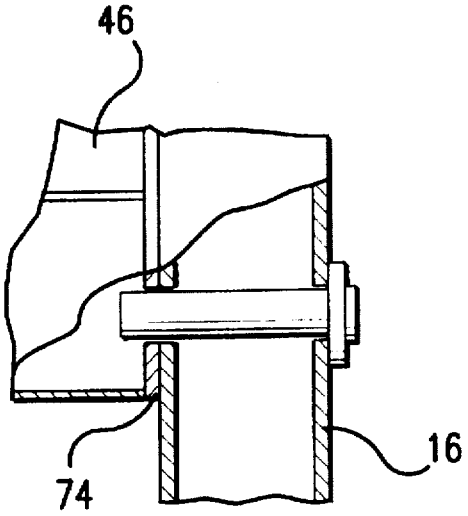
FIG. 9 is a partial enlarged view taken from the area indicated in FIG. 5.
Figure 10:
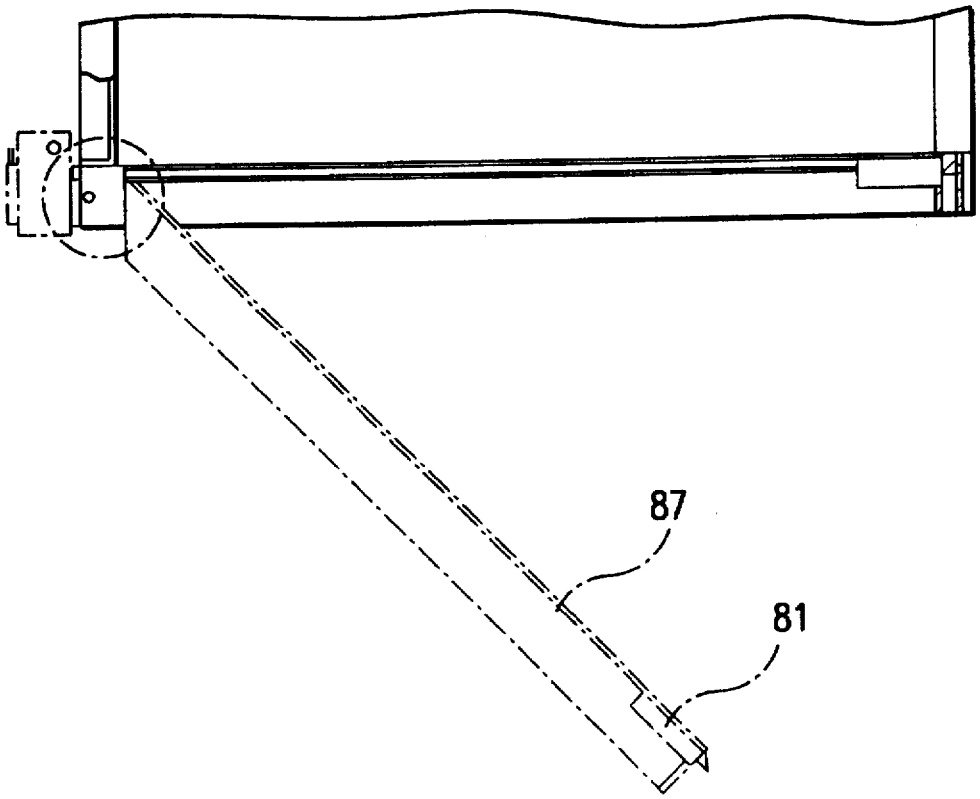
FIG. 10 illustrates a partial right side elevational view showing the trap door of the container in open and closed position.
Figure 11:
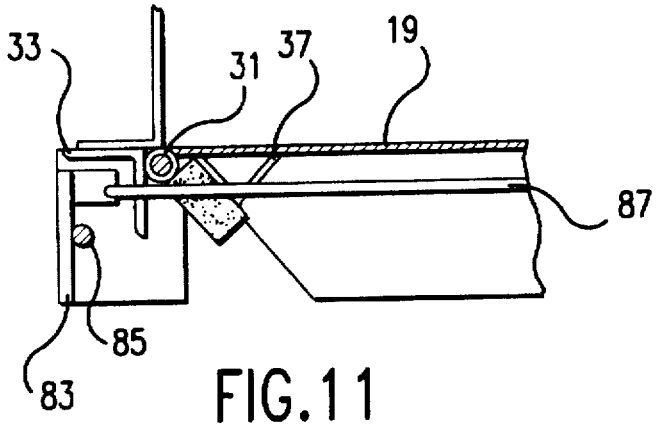
FIG. 11 illustrates an enlarged view of the encircled portion of FIG. 10.
Figure 12:
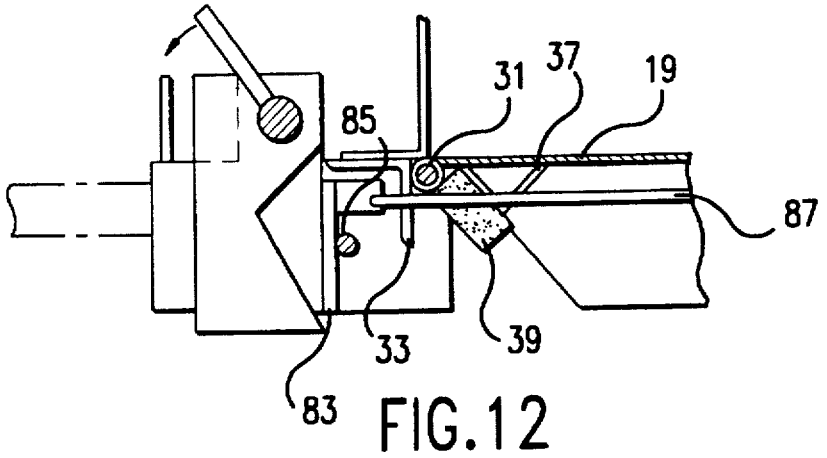
FIG. 12 illustrates a partial side elevational view showing the separate trip hammer assembly positioned on fork lift tines adjacent to the pivotal connection between the trap door and the container.
Figure 13:
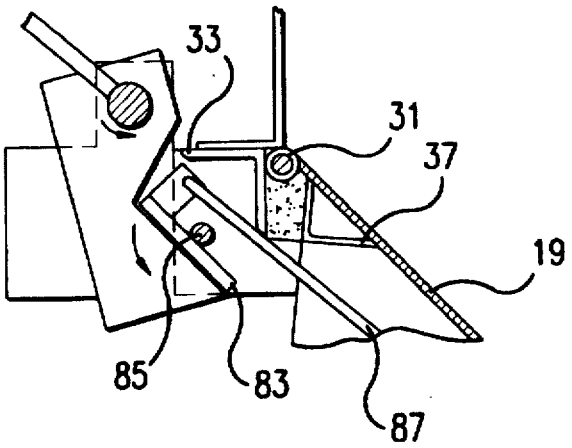
FIG. 13 illustrates a partial side elevational view similar to the view of FIG. 12 with the trip hammer assembly actuated to pivot the trap door latch release lever.
Figure 14:
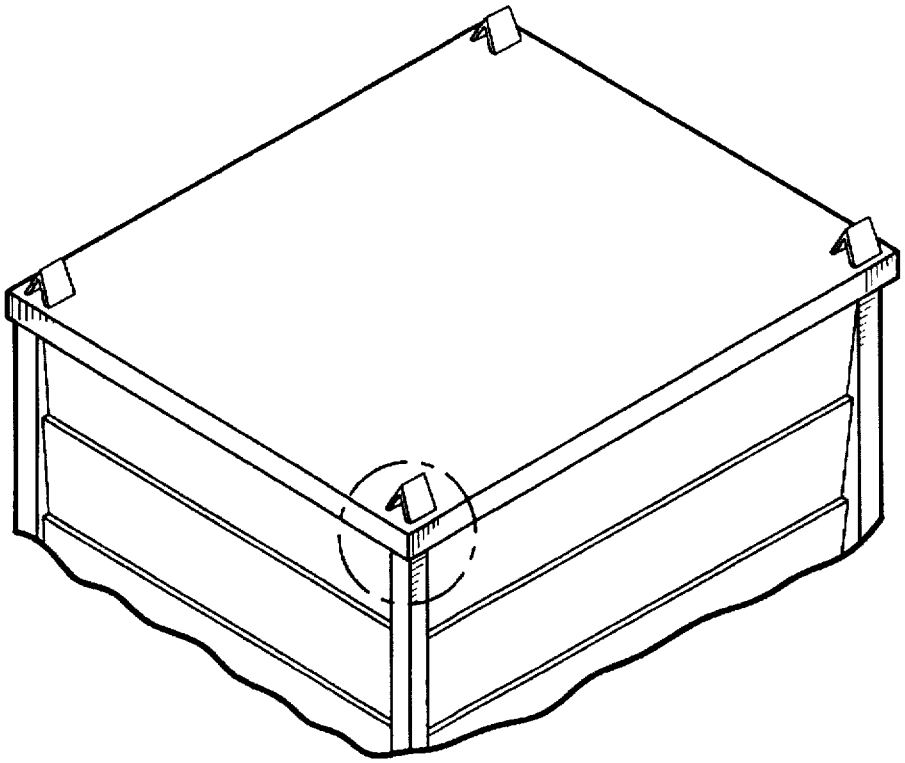
FIG. 14 illustrates a top perspective view of a cover in position on a container with stacking tabs projecting upwardly from each corner of the cover.
Figure 15:
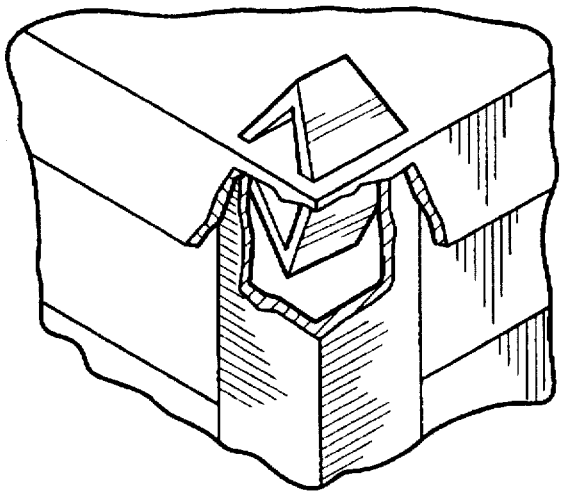
FIG. 15 illustrates an enlarged view of the encircled portion of FIG. 14.
Figure 16:
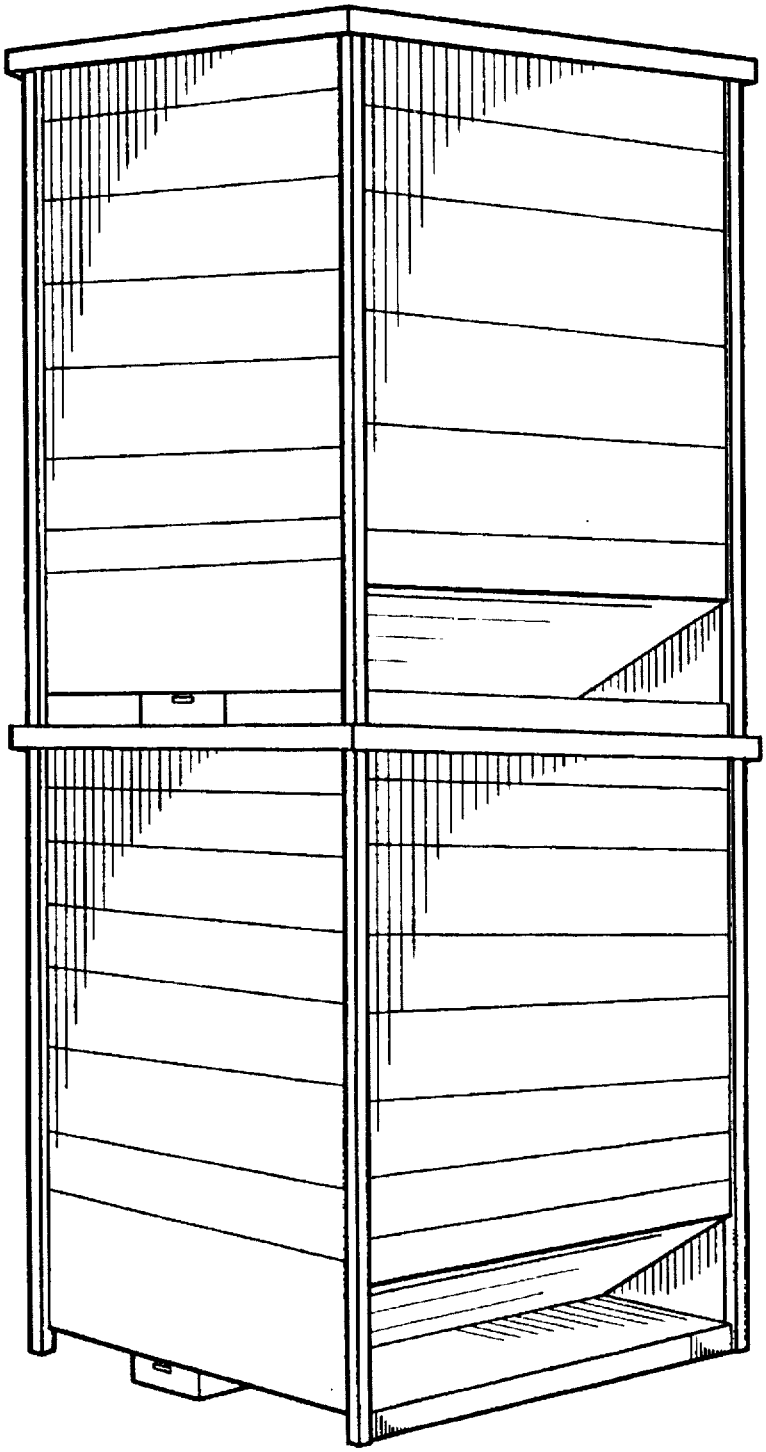
FIG. 16 illustrates two containers according to the present invention in a filled and stacked configuration.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

A container according to an embodiment of the present invention includes a base portion and upper side walls that can be pivoted from a vertical position to a horizontal position in order to reduce the overall height of the container after the contents of the container have been emptied. The base portion of the container is formed with four vertical square tube members 10, 12, 14 and 16, which define the four corners of the base portion. Square tube members 10 and 12 are welded at their lower ends to the outer surface of a lower structural member 18 extending along one side of the bottom of the base portion. Square tube members 14 and 16 are likewise welded to the outer surface of lower structural member 20 extending along the opposite side of the bottom of the base portion of the container.

As shown in FIG. 1, lower structural members 18 and 20 are parallel to each other and spaced at a distance that allows entry of standard forklift tines or pallet jack tines into respective spaces 101 and 102 defined between the outer surfaces of lower structural members 18 and 20. The inner edges of lower structural members 18 and 20 define an elongated opening 17 that extends the length of the base portion of the container. A trap door 19 is pivotally mounted to one end of the base portion of the container and when in a closed position prevents the contents of the container from emptying through opening 17. Two parallel flat plates 25 and 26 are connected to respective inner surfaces of lower structural members 18 and 20 at one end of the container. An angle 33 is connected between plates 25 and 26 and forms a support for a horizontal hinge assembly 31 connected to trap door 19.

A spring lock assembly 81 is mounted to the distal end of trap door 19 opposite from the end of trap door 19 pivotally connected to angle 33. A latch release lever 83 is pivotally mounted between plates 25 and 26 by a horizontal rod 85. Pivotal motion of latch release lever 83 about rod 85 results in actuation of spring lock 81 through connector 87 that joins the latch release lever 83 to spring lock 81. Spring lock 81 is provided with a latch that engages in a hole formed through an end plate 21 welded across the ends of lower structural members 18 and 20. Pivotal motion of latch release lever 83 pulls connector 87 to release the latch of spring lock 81 from the hole through end plate 21, thus allowing trap door 19 to pivot about hinged connection 31 to an open position.

A resilient bumper 39 is connected to an angle 37 welded across the bottom surface of trap door 19 such that as trap door 19 is opened, bumper 39 contacts angle 33 and prevents trap door 19 from opening beyond a 45° angle. Closure of trap door 19 is achieved by lowering the container while backing up the lift truck that supports the container underneath lower structural members 18 and 20. Once the container has been seated back on a flat surface, the latch of spring lock 81 has reengaged with the hole through end plate 21.

The bottom surfaces of the containment portion of the container are formed by bottom surface members 22 and 24 extending from the sides of the base portion of the container to the elongated opening 17. Bottom surface member 22 is connected at its outer and upper edge to square tube members 14 and 16, and bottom surface member 24 is connected at its outer and upper edge to square tube members 10 and 12. The bottom edges of bottom surface members 22 and 24 are connected along the innermost edges of lower structural members 18 and 20.

Bottom end plates 30 and 32 are connected at their outer edges between square tube members 10, 12, 14 and 16. Bottom end plate 30 is welded to the ends of bottom surface members 22 and 24 at one end of the container and bottom end plate 32 is welded to the opposite ends of bottom surface members 22 and 24.

The upper portion of the container is formed with upper square tube members 50, 52, 54 and 56, and upper sides 40, 42, 44 and 46. Flat bar members 64 and 70 are connected along opposite edges of the side 40. Similarly, flat bar members 68 and 66 are connected along opposite side edges of side 42. Flat bar members 60 and 62 are connected along opposite side edges of side 44; and flat bar members 60 and 62 are connected to upper square tube members 50 and 52. Similarly, flat bar members 72 and 74 are connected along opposite side edges of side 46; and flat bar members 72 and 74 are in turn connected to upper square tube members 56 and 54.

Angle keepers 80, 82, 84 and 86, are also welded to upper square tube members 52, 50, 56 and 54, respectively, such that a gap is defined between the angle keepers and the upper square tube members. The gaps defined between the angle keepers and upper square tube members receive the overlapping portions of the flat bar members 70 and 64, and 66 and 68, connected along the edges of sides 40 and 42, respectively. When all four sides are in a vertical position the interlocking relationship between the flat bar members connected along the edges of the upper sides and the angle keepers connected to the upper square tube members ensures the integrity of the containment portion of the container. The outward pressure created by the material placed in the containment portion of the container forces the upper side walls into the interlocking relationship.

When the upper square tube members are positioned in alignment over respective lower square tube members, alignment tabs extending from the bottom openings of the upper square tube members enter the top openings of the lower square tube members to help hold the upper sides in position until enough material is poured into the container to force the upper sides into an interlocked relationship.

As discussed earlier, the lower ends of the flat bar members connected to the side edges of each side 40, 42, 44 and 46 are provided with elongated slots therethrough for receipt of a pin extending laterally from each of the lower square tube members. When it is desired to pivot the side walls of a container to a horizontal position after emptying of the container, each of the side walls can be lifted vertically relative to the lower square tube members as a result of the elongated slots through the flat bar members along the edges of the sides. This vertical movement of each side disengages the alignment tabs extending from the lower end of each upper square tube member from the opening at the upper end of each lower square tube member. After disengagement of the alignment tabs, each side can be pivoted from the vertical position to a horizontal position. In a preferred embodiment each of the sides is folded inwardly to a horizontal position in sequence with the sides that are not connected to the upper square tube members being folded inwardly first followed sequentially by the sides that are connected to the upper square tube members.

Modifications and variations of the above-described embodiments of the present invention are possible, as appreciated by those skilled in the art in light of the above teachings.

It is therefore to be understood that, within the scope of the appended claims and their equivalents, the invention may be practiced otherwise than as specifically described.

What is claimed is:

1. A collapsible, stackable container comprising:

a base portion;

a plurality of substantially rigid side walls;

each of said side walls being pivotally connected to said base portion and movable from a horizontal position across the top of said base portion to a vertical position extending upwardly from said base portion and defining a containment cavity between said side walls, two opposite side edges of each of two of said rigid side walls being connected to upper square tube members and each of said upper square tube members being provided along a longitudinal edge thereof with an angle keeper, wherein a gap is provided between said associated upper square tube members and said angle keepers, and two opposite side edges of each of two other side walls of said rigid side walls being connected to flat plates extending substantially perpendicular to said other side walls such that said flat plates are received within said gaps when said rigid side walls are pivoted to a vertical position; and a trap door pivotally connected at said base portion and extending across an opening defined in said base portion for emptying contents from said container.

2. The container of claim 1, wherein said trap door is pivotally mounted to one end of said base portion of said container by a horizontal hinge assembly, and said horizontal hinge assembly being supported by an angle member extending partially across said base portion in a direction substantially perpendicular to a longitudinal extent of said opening, and said trap door having a latch at an end of said trap door opposite from said hinge assembly, a connector extending from said latch to a latch release lever pivotally mounted on a horizontal rod extending adjacent to and parallel to said hinge assembly, such that pivotal motion of said latch release lever about said horizontal rod actuates said latch through said connector.

3. The container of claim 1, wherein said base portion includes two parallel members extending along a bottom of said base portion for receiving tines of a forklift or pallet jack;

four lower square tube members being connected to outside corners of said parallel members and forming corners of said base portion; and angled bottom surfaces of said base portion converging downwardly to said opening for emptying contents from said container.

4. The container of claim 3, wherein said upper square tube members align with said lower square tube members when said rigid side walls are pivoted to a vertical position.

* * * * *